United States Patent [19]

Gundlach

[11] Patent Number: 4,617,709

[45] Date of Patent: Oct. 21, 1986

[54] SEGMENTAL SHELL FOR A COAL CRUSHER ROLL INCLUDING SPECIALIZED REMOVAL MEANS

[75] Inventor: Theodore F. Gundlach, Belleville, Ill.

[73] Assignee: T. J. Gundlach Machine Company, Belleville, Ill.

[21] Appl. No.: 586,571

[22] Filed: Mar. 5, 1984

[51] Int. Cl.[4] ..... B21B 27/00

[52] U.S. Cl. ..... 29/124; 241/294

[58] Field of Search ..... 29/124; 241/285 R, 293, 241/294, 295, 300, 285 B, 285 A

[56] References Cited

U.S. PATENT DOCUMENTS

| | | | |
|---|---|---|---|
| 12,451 | 9/1887 | Williams | 241/293 |
| 1,085,908 | 2/1914 | Hoe | 29/124 |
| 1,390,693 | 9/1921 | Fernandez | 29/124 |
| 2,887,276 | 5/1959 | Minarik | 241/293 X |

*Primary Examiner*—Mark Rosenbaum
*Assistant Examiner*—Timothy V. Eley
*Attorney, Agent, or Firm*—Cohn, Powell & Hind

[57] ABSTRACT

A coal crusher roll includes a smooth tubular cylindrical back-up roll having a series of regularly spaced tapped radial holes to receive bolts by which eight identical shell segments may be fastened on the back-up roll. The holes at the axial ends of the segment are undercut to provide a rabbet into which fits the tang of a special lifting hook by which the segment can be easily handled by a lightweight crane. A recess in the central part of the segment defined by a peripheral berm around the backside of the segment reduces the weight of the segment, provides a place for receiving balancing weights, and simplifies the face fit machining for the segment with the back-up roll.

10 Claims, 6 Drawing Figures

SEGMENTAL SHELL FOR A COAL CRUSHER ROLL INCLUDING SPECIALIZED REMOVAL MEANS

BACKGROUND OF THE INVENTION

Coal crushers have been available and in use for many years for breaking coal into small pieces suitable for handling and burning. The best crushers available are capable of breaking the coal into precisely the desired range of particle sizes which are best for the particular application such as pipeline transportation or particular coal preparation plants. The breaking of the coal into precisely desired sizes is done by passing the coal between two crusher rolls which have intermeshing teeth which are spaced apart a certain distance axially and circumferentially so that the coal is broken to the desired size, with minimal production of "fines."

After a period of use, the chisel teeth on the crusher rolls wear down to the extent that the coal pieces passing through the crusher exceed the desired size. When this happens, it is necessary to correct the situation either by building up the teeth on the crusher rolls by welding or by replacing the rolls altogether. In either case, it is necessary to remove the roll and replace it with a new or repaired roll while the worn roll is being repaired or replaced.

Removal of the roll from the coal crusher necessitates that the crusher be taken out of service while the rolls are being replaced. It is therefore desirable that the roll replacement process be as fast as possible to reduce the amount of time that the coal crusher is out of service. However, coal crusher rolls are extremely large and heavy, especially for large, efficient machines and the process of removing a roll is a lengthy one. It requires the disassembly and/or disconnection of the roll bearings and the drive mechanism and requires very careful and precise manipulation of the large heavy roll by a large crane. Because of the size and mass of the roll, the process of removing a roll must be done with great care to prevent damage to surrounding equipment, to the roll itself, and to the workers in the vicinity. The replacement of the roll is just as difficult and ticklish a business as the removal of the roll and the entire roll replacement process could take several days. In the time that this work is under way, the coal crusher is out of operation with resulting economic loss and loss of production.

It has been proposed in the past to make coal crushers with removable roll segments. The removable roll segments of the prior art have suffered from numerous disadvantages which have retarded their acceptance by the industry. One problem is the achieving of a close face fit between the roll segment and the roll on which it is mounted. Unless this face fit is extremely precise, the cyclic forces on the roll segment can cause it to fret and abrade the roll on which it is mounted and can also cause fatigue of the fasteners by which the segment is attached to the roll. The prior art has attempted to solve that problem by various strategems, such as zinc coating and precision machining, but these strategems are expensive and not always successful.

Because of the extreme vibration encountered in a coal crusher, the fasteners which hold the segments to the roll must be extremely resistant to becoming loose under vibration. This problem has been recognized in the past and has been approached by using lock nuts on the attachment bolts to lock the nut in place, by cotter pins through the end of the bolt or other similar techniques. These are undesirable because of the greatly increased time required to secure the fastener and also because, while these techniques prevent the attachment bolts from falling out of the machine altogether, they do not always prevent them from becoming loose. The loose bolts are useless to hold the segment in place and allow it to flex and fret against the support roll.

Prior art coal crushers with removable segments have utilized ribs or splines in the backside of the segment which fit into corresponding grooves running axially along the roll face to prevent circumferential forces exerted on the segments during crushing from shearing the attachment bolts. The cost of special machining in the support roll and corresponding difficulties in ensuring the correct placement and size of the ribs in the segment casting has greatly increased the cost of the removable segment system, but it or some variant of this scheme for carrying circumferential stresses has usually been considered necessary because the shearing of the attachment bolts on the segments can result in catastrophic failure of the crusher and require replacement of the entire crusher.

SUMMARY OF THE INVENTION

Accordingly, it is an object of this invention to provide a roll for a coal crusher having removable segments which are easily and quickly removed and replaced without removal of the crusher roll from the machine.

It is another object of this invention to provide a segment for a coal crusher roll which is inexpensive to produce but reduce or eliminates circumferential shear forces from acting on the attachment bolts.

It is another object of this invention to provide a segment for a coal crusher roll which has an attachment which locks into a receptacle on the segment which is protected from wear in use.

It is a further object of this invention to provide a segment for a crusher roll having a reduced weight, a simplified system for ensuring a precise face fit to the support roll, and a simple and effective means for balancing the crusher roll.

The objects of the invention are attained in the preferred embodiment of a coal crusher roll having a smooth tubular cylindrical back-up roll having a series of regularly spaced radial holes drilled through the roll and tapped to receive bolts. A series of identical segments may be mounted on the back-up roll with machine screws provided on their threads with an anaerobic adhesive. The segments are provided with counterbored holes which align with the holes in the back-up roll to receive the screws and attach the segments to the roll. The holes at the axial ends of the segments are undercut to provide rabbets that enable special lifting hooks to be placed in the bolt holes while the segment is still fastened to the back-up roll with the other bolts. The lifting hook enables the segment to be easily handled by a lightweight crane, and the undercut rabbet and tang arrangement makes it possible to insert or remove the hooks when the segment is attached to the back-up rolls so that the segment may be supported by the hooks while the bolts are being removed, and may also be maneuvered into position and bolted in place without first removing the hooks. A recess in the central part of the segment defined by a peripheral berm around the backside of the segment reduces the weight of the segment, provides a place for receiving balancing weights, and simplifies the face fit machining or casting for the segment with the back-up roll. The peripheral berm also reduces the surface area contact with the back-up roll so that the force exerted by the attachment screws is concentrated over a smaller area and, therefore, the pesssure between the segment and the back-up roll in the region of the attachment bolts is much greater than would otherwise be the case, thereby providing a greater force to resist the circumferential force exerted on the segment in use so that the attachment bolts are subject to a reduced shear force.

DESCRIPTION OF THE DRAWINGS

The invention and its many attendant objects and advantages will be better understood upon reading the following description of the preferred embodiment in conjunction with the following drawings, wherein.

DESCRIPTION OF THE PREFERRED EMBODIMENT

Figure 1:
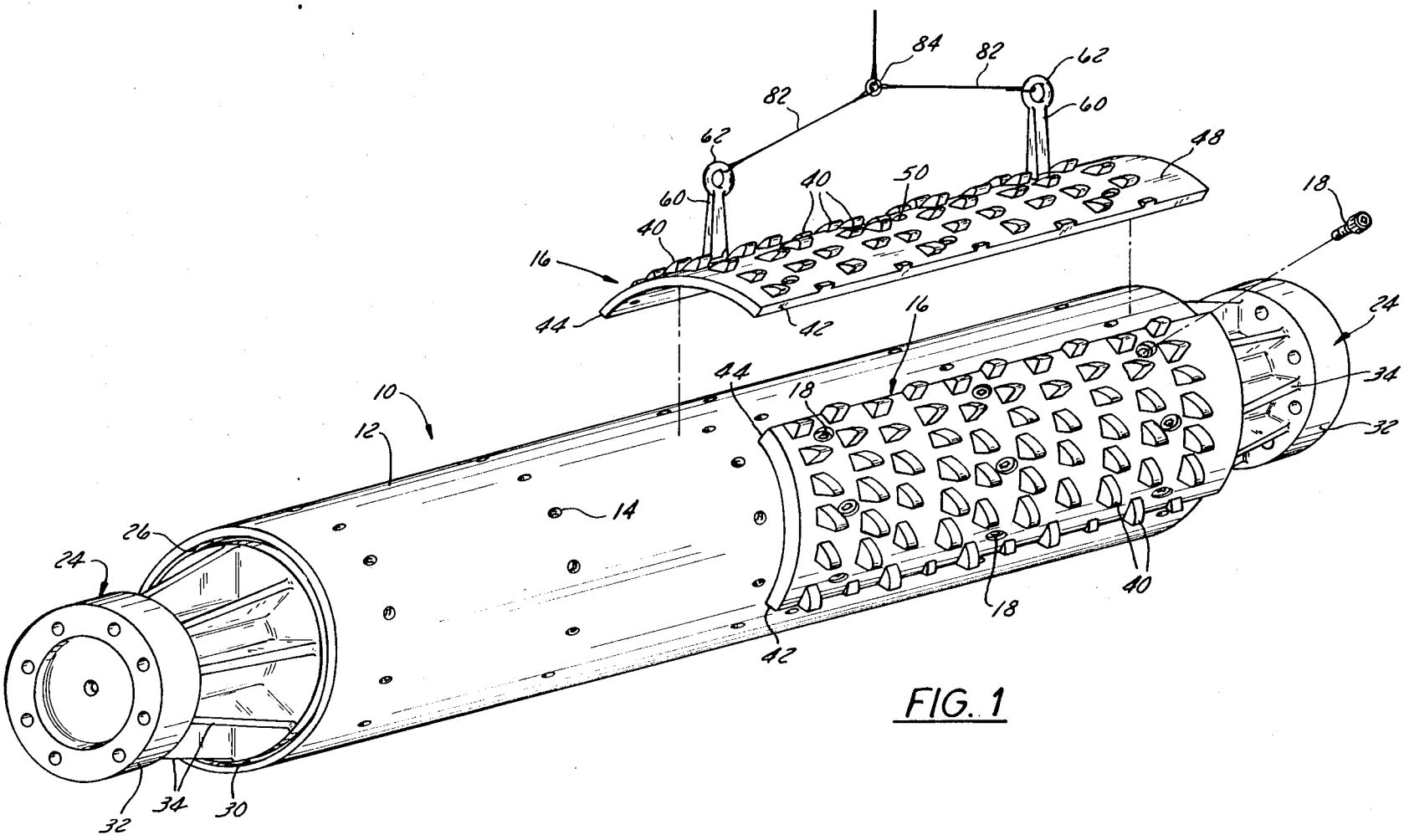
FIG. 1 is a perspective view of a crusher roll made in accordance with this invention showing one segment attached to the roll and a second segment being removed by the special lifting hooks made for this purpose.
Figure 2:
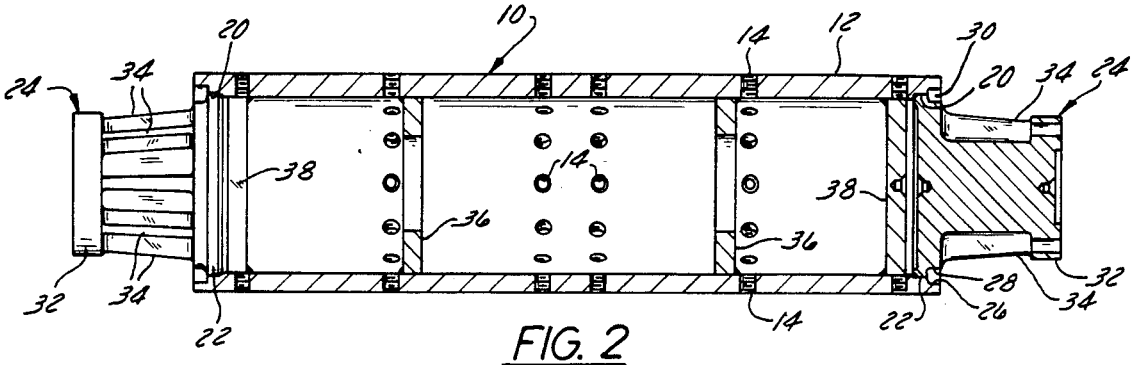
FIG. 2 is a sectional elevation of the back-up roll for the crusher roll shown in FIG. 1.

Referring now to the drawings wherein like reference numerals identify identical or corresponding parts, and more particularly to FIGS. 1 and 2 thereof, the back-up roll 10 for the crusher roll illustrated is shown as a cylindrical tube 12 through which are drilled a series of regularly spaced holes 14. The placement of the holes 14 in the back-up roll will be explained in particular in connection with a description of removable segments 16 which are fastened by bolts 18 to the back-up roll 10.

As shown in FIG. 2, each end of the cylindrical tube 12 has two annular recesses machined into the end of the tube. An inner recess 20 is machined to receive an inner end rim 22 of a hub 24. An outer recess 26 cooperates with a corresponding recess 28 in the rim 22 of the hub 24 to provide an annular groove 30 in which the hub can be securely welded to the cylindrical tube 12. The outer end of the hub 24 is provided with a peripheral flange 32 by which the hub can be attached to a suitable bearing and drive structure. A series of longitudinal vanes or flutes 34 is provided between the rim 22 and the outer flange 32 for additional strength of the hub 24.

A series of radial stiffeners 36 (two being shown in FIG. 2) in the form of heavy annular rings is provided at approximately $\frac{1}{3}$ the length of the tube inside and are welded in place by a peripheral weld. A diagonal bar 38 is welded across each end of the cylindrical tube 10 primarily for ease of handling during manufacturing. The ends of the tube are radially supported by the solid end of the hub 24 and the radial stiffeners 36 support the tube at the $\frac{1}{3}$ positions. The tube itself is extremely strong because it does not have grooves or other configurations cut into it for circumferential support of the segments and, therefore, it does not suffer from the stress peaking problems which such configurations could cause in a tubular back-up roll. Accordingly, the crusher roll of this invention provides exceptional strength without undue weight.

Figure 3:
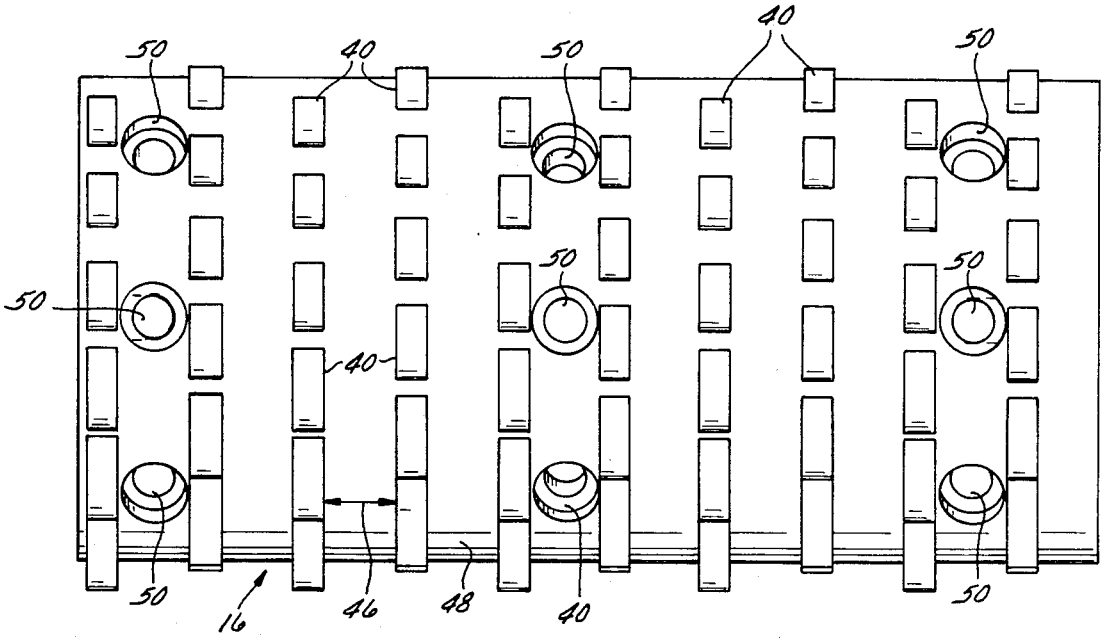
FIG. 3 is a plan view of one of the segments shown in FIG. 1.
Figure 4:
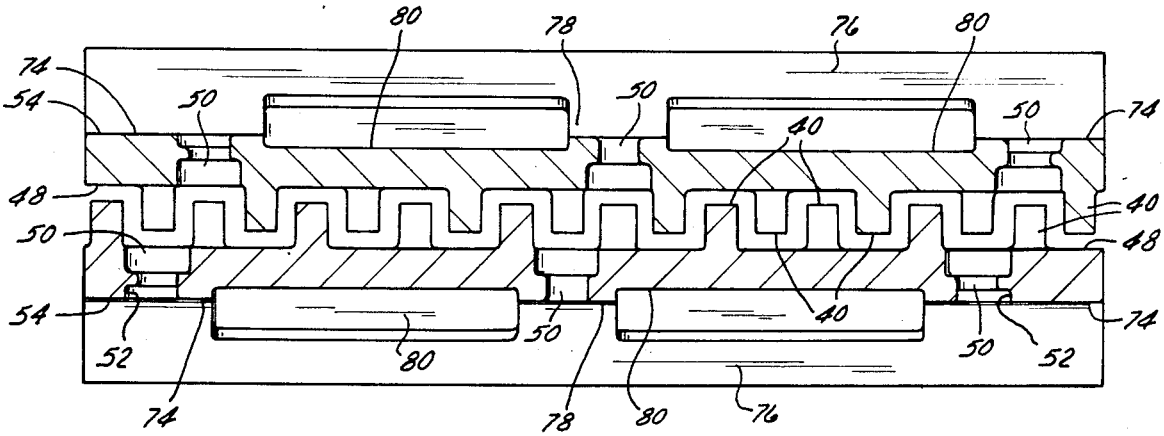
FIG. 4 is a sectional elevation of two meshing segments of the type shown in FIG. 2.
Figure 5:
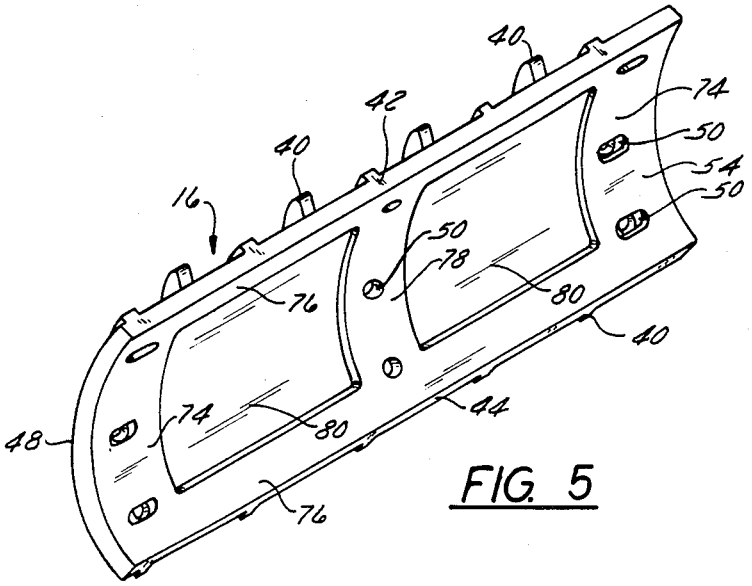
FIG. 5 is a perspective view of the backside of the segment shown in FIGS. 3 and 4.

Turning now to FIG. 3, a removable segment 16 for the inventive crusher roll is shown having a series of chisel teeth 40 arranged in ten columns of six teeth each. The teeth in adjacent rows are staggered $\frac{1}{2}$ pitch so that each tooth 40 is axially aligned with the space between two teeth in the adjacent columns. Five of the columns have six complete teeth and the other five columns have five complete teeth and two partial teeth. As shown, for example, in the second column from the left-hand edge in FIG. 3, and more particularly as shown in the same column in FIG. 1, the partial teeth along the leading circumferential edge 42 match up to the partial teeth along the trailing circumferential edge 44 of the adjacent segment to form a complete tooth 40. This preserves the circumferential spacing between all of the teeth on the breaker roll and prevents voids while making it possible to have the leading and lagging circumferential edges be straight.

The axial space 46 between the centerlines of adjacent columns of teeth 40 is equal to about three times the axial thickness 47 of the teeth. In use, the breaker roll of the coal crusher is placed parallel to and horizontally spaced from another breaker roll and positioned so that the teeth of the other breaker roll are positioned exactly in the center of the spaces 46 between the teeth in this breaker roll, and vice versa. The breaker rolls are mounted in the machine so that the horizontal spacing between them is adjustable. By adjusting the horizontal distance between the two breaker rolls, it is possible to control the size of the particles of the output coal stream.

The sum of the distances A+B between the centerline of the column of teeth adjacent each circumferential edge of the segment and the circumferential edge of the segment itself is equal to the axial spacing 46 between adjacent columns of teeth on the segment. In this way, the segments, when attached to the back-up roll 10, will continue the same spacing between adjacent columns of teeth as exist in each segment individually.

Nine holes are drilled in the segment in a uniform pattern as shown. The holes are in the form of three circumferentially aligned columns and three axially aligned rows. The sum (C+D) of the distance (C) between the right-hand column of holes and the right-hand circumferential edge of the segment, plus the distance (D) between the left-hand column of holes and the left-hand circumferential edge of the segment is equal to $\frac{1}{4}$ of the distance between the right and left columns of holes and is equal to $\frac{1}{2}$ the distance between adjacent columns of holes. The spacing of the holes may also be described by referring to the back-up roll 12 as a cylinder having a circumference, and each curved segment 16 as comprising a quarter of that circumference. The aforementioned nine holes may be referred to as being arrayed in three axially extending rows, comprising a top row adjacent edge 42, a center row and a bottom row, adjacent edge 44. The center row is spaced about 30° each from the adjacent top and bottom rows. The top and bottom rows are each spaced about 15° from the adjacent edges 42 and 44, respectively, of the segment 16. The purpose of this hole spacing is as follows:

1. Once the back-up rolls are mounted in the machine, there is only one possible way of mounting the segments. It is impossible to mount the segments on the rolls backwards or so that the teeth would interfere because the segments then would be shifted axially with respect to the back-up roll and it would be obvious that they were being put on incorrectly.

2. It provides an ideal spacing for the holes on the segment so that they are near, but not too near, the edges of the segment, and the two center columns of holes in the back-up roll are not so close together to weaken the back-up roll.

3. A single segment can be used for all positions on both back-up rolls in the machine and identical back-up rolls can be used in both positions in the crusher, just switched end-for end. The holes in the back-up rolls are positioned to ensure that the segments are aligned with the axial ends of the back-up roll and the ½ spacing of the two center columns of holes in the roll ensures that the teeth on the other roll will be exactly aligned between the teeth on the first roll when the second roll is switched end for end with the first roll.

Each of the holes in the two end columns is provided with a special rabbet 52 where the hole opens on the inside face 54 of the segment 16. The rabbet 52 is formed by counterboring the holes 50 where they open in the inner face 54 of the removable segment 16. The counterboring is done with a cutting tool having the same diameter as the holes 50, but on a centerline which is shifted at least about ½ of the radius of the holes 50 in the outward axial direction only to ensure that the lifting hook will be inserted properly with the hook tank facing outwardly. This produces an elongated rabbet having a width equal to the diameter of the holes 50.

Figure 6:
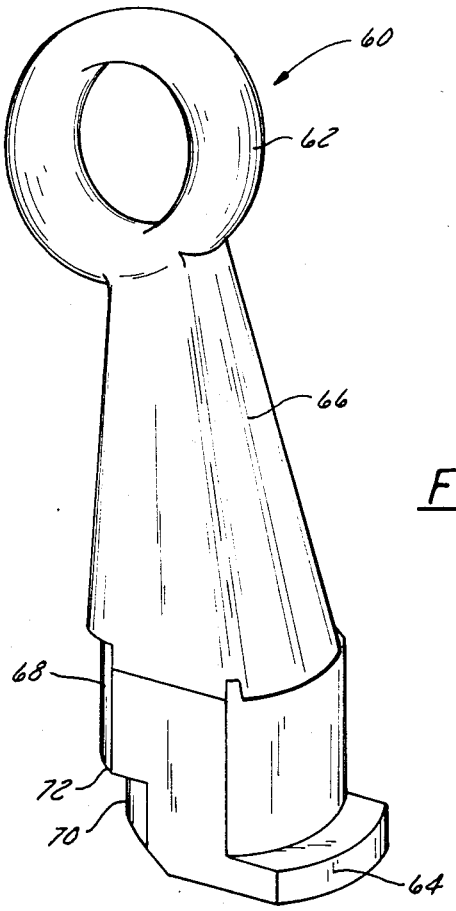
FIG. 6 is a perspective view of the lifting hook shown in FIG. 1.

A lifting hook 60, most clearly shown in FIG. 6, includes a top end ring 62 and a bottom end tang 64 at opposite ends of a hook body 66. In use, two or four of the hooks will be used to manipulate the segment, two being used as shown in FIG. 1. The orientation of the hook shown in FIG. 1 will be used to give positional names to the parts of the hook. For example, in use the end ring will be facing upward and therefore will be called the top end ring, and the tang 64 will be at the bottom end and therefore is called the bottom end tang. The center of the top end ring is displaced from the centerline of the hook body 66 toward the center or inside of the segment when the hook is in use and therefore the edge of the hook toward which the ring is displaced will be called the inside edge, and the opposite edge will be called the outside edge.

As shown most clearly in FIG. 6, the inside edge of the hook 60 is aligned with the center of the top end ring 62, and the outside edge of the hook boy 66 is tangent to the hole in the top end ring 62. This ensures that the stress lines at the outside portion of the end ring 62 will be smooth and continuous with no discontinuities for maximum strength of the ring. The lifting hook 60 may be a one piece forging or may be cast or flame cut.

The hook body 66 flares smoothly down to a rounded rectangular base portion 68. A notch 70 is formed in the base portion to provide a ledge 72 which engages the shoulder formed by the counterbore of the counterbored holes 50. The tang 64 projects outwardly in the direction opposite from the offset of the end ring 62. The tang 64 is rounded with a radius of curvature approximately equal to the radius of curvature of the rabbet so it fits neatly into the rabbet 52 and the ledge 72 of the notch 70 engages the shoulder of the top counterbore of the holes 50. When the cable shown in FIG. 1 exerts an inward and upward pull on the end ring 62, the tang 64 and the shoulder 72 lock securely in place in the counterbored hole 50 to secure the lifting hook in place until the cables are removed. Only by tilting the hook in the same direction in which it was tilted to insert the hook in the counterbored hole 50 may the lifting hook 60 be removed from the hole.

The inner face 54 of the removable segment 16 is provided with a circumferential peripheral berm 74 along both circumferential edges of the segment, and an axial peripheral berm 76 along both leading and lagging axial edges 42 and 44 of the segment. In addition, a central berm 78 is provided parallel to the circumferential berms 74 and connecting the leading and lagging axial berms 76. Two square recesses 80 are defined between the berms. The recesses 80 provide a means for reducing the metal content of the segment and thereby reducing its weight and cost, and also they provide a receptacle for placing balancing weights between the segments and back-up roll to ensure that the breaker rolls will be balanced in use so as not to exert undue unbalanced forces on the bearings and run smoothly with minimal vibration.

The berms are radially aligned with the counterbored holes 50 in the segment and provide a means for securely fastening the segment to the back-up roll 10. When the screws are passed through the holes 50 and are threaded tightly into the threaded holes 14 in the back-up roll, they exert an enormous force on the segment against the back-up roll. Because of the relatively restricted size of the berm, this force is carried entirely by a relatively small area and consequently the pressure at the interface between the berm and the back-up roll is enormous. Since the segment is harder material than the back-up roll, the microscopic strain tends to embed the berm of the segment slightly into the surface of the back-up roll or to closely interengage the surface aspirities of the facing surfaces of the berms and the back-up roll so that the frictional force, which is very great in any case, is actually increased because of the embedding or interengaging effect. The result is that the frictional force between the segment and the back-up roll is so great that the circumferential forces acting on the segment during the crushing process are largely carried by this frictional force so that little or no shear forces are exerted on the bolts.

In operation, lifting hooks are placed in the outer circumferential columns of holes at both ends of the segment, and the top end rings 62 of each of the lifting hooks 60 are connected by cables 82 only slightly longer than the segment. This ensures that a strong axial force will be exerted on each hook to securely lock it in place and prevent accidental disengagement.

The cables 82 are connected in the middle by a ring 84 and lifted from the ring 84 by a crane. The segment is lifted by the crane into position on the back-up roll 10 and is secured in position by two or more screws while it is supported by the hooks. Once attached, the listing force is relieved and the hooks 60 may be removed by merely tilting them outward away from each other and lifting them clear of the hole 50. Each of the other segments is similarly secured in position. While the segments are being attached to the back-up roll, it is held in angular position against rotation which would occur because of massive unbalance when some but not all of the segments are attached to the roll.

When all of the segments are attached, the roll is turned freely and, if it is unbalanced, a set of test weights is attached by the screws 18 until the approximate balance is achieved. Then the segments where the weights are to be attached are removed and the weights are placed in the recesses 80. A convenient form of balance weight is a curved plate equal or slightly smaller in size to the recesses 80 so that the plate need merely be placed and fastened in position. Once the balance weights have been placed, all of the bolts are coated with an anaerobic adhesive such as Locktite 277 and are threaded into position. The bolts are then torqued down firmly to provide the required radial force. Eight hundred foot pounds of torque or greater on a 1½ inch screw with six threads per inch has been found to exert a sufficient radial force on nine equally spaced positions on a 420 pound segment to hold it securely in position.

Obviously, numerous modifications and variations of the above-identified invention will occur to those skilled in the art in light of this disclosure. Accordingly, it is expressly to be understood that these modifications and variations and the equivalents thereof may be practiced while remaining within the spirit and scope of the invention as defined by the following claims.

I claim:

1. In a coal crusher having a cylindrical back-up roll having two ends, an outside face, a longitudinal axis, and a hub mounted in each end of said back-up roll; a combination of a plurality of removable toothed segments mounted to said outside face of said roll and hook means including a tang for removing said segments from said roll comprising a plurality of metal segments, each of said segments in the form of a sector of a tube, said segment having an inside face and an outside face and an outside peripheral edge, said edge including upper and lower axially extending edges, and two circumferential edges, the inside face of said segment having a radius of curvature substantially equal to the radius of curvature of the outside face of said back-up roll and having a plurality of counterbored holes therein for receiving headed bolts which are threaded into tapped holes in said back-up roll to secure said segments to said back-up roll, each of said counterbored holes having a seat to receive said heads of said bolts;

said members designed to be mounted to said back-up roll in a plurality of circumferentially arranged, axially extending, adjacent rows on said outside surface of said roll;

a rabbet at the opening of at least two of said holes on the inside face of said segment, each of said rabbets having an upper surface and formed by a counterbore, said counterbore forming a shoulder which can be engaged by said tang of said hook means; and said hook means designed to be releasably inserted into said rabbetized holes so that when a lifting force is exerted on said hook means, said hook means becomes locked into said rabbet to permit the safe removal and replacement of said member on said back-up roll.

2. The combination defined in claim 1, wherein said segment has a multiplicity of teeth on the outside face of said member, each of said teeth having a peripheral edge and an axial thickness, some of said teeth on the two axially extending edges thereof being partial teeth, said partial teeth on each segment aligning with complimentary partial teeth on each adjacent segment so as to form complete teeth bridging adjacent segments.

3. The combination defined in claim 1, wherein each of said rabbets has a radius at least about equal to the radius of one of said counterbored holes and each of said rabbets having a centerline axially offset from a respective one of said counterbored holes at least about ½ the radius of a respective one of said counterbored holes.

4. The combination defined in claim 1, wherein said rabbetized holes are arranged in two circumferentially aligned columns, one adjacent each circumferential edge of said segment, the sum of the distances between the two columns and their respective adjacent segment edges being approximately one quarter the distance between the two columns of holes.

5. The combination defined in claim 4, further comprising an additional column of holes in said segment approximately equidistant between the two columns of holes adjacent the edges of said segment.

6. The combination defined in claim 1, wherein said holes are arranged in three axially extending rows, comprised of top, center and bottom rows, the center row being spaced about 30° each from the adjacent top and bottom row, and the top and bottom rows, one each adjacent an axially extending edge of said segment, and each of said rows being spaced about 15°0 from the respective adjacent axially extending edge of said segment, and said segment being about one quarter of a cylinder.

7. The combination defined in claim 2, wherein the axial spacing between the adjacent edges of said teeth being about equal to twice the axial thickness of the teeth, and the sum of the distances between the teeth adjacent each circumferential edge of said segment and the respective adjacent segment edge being equal to the distance between adjacent teeth on said segment.

8. The combination defined in claim 7, wherein the diameter of the counterbore of each of said counterbored holes is approximately equal to the axial space between said teeth.

9. The combination defined in claim 1, wherein said hook means further comprises a lifting hook having an elongate body with a longitudinal axis, an upper end and a lower end, an eye at said upper end, a tang at said lower end, said eye having a portion offset in one direction from said axis of said body and said tang projecting from said body in a direction opposite the direction of offset of said eye.

10. The combination defined in claim 9, further comprising a notch in the lower end of said body on the side thereof opposite said tang, said notch forming a downwardly facing ledge that engages said seat of said counterbore of each of said counterbored holes, while said tang engages the top surface of said rabbets when said hook is in place in a said hole and supporting said segment.

* * * * *